United States Patent [19]

Lurkis et al.

[11] 4,101,876

[45] Jul. 18, 1978

[54] PHOTO ELECTRIC SECURITY SYSTEM

[75] Inventors: Alexander Lurkis, Holliswood; John I. Hill, Ronkonkoma, both of N.Y.

[73] Assignee: Glimmer Security Systems Inc., Floral Park, N.Y.

[21] Appl. No.: 761,785

[22] Filed: Jan. 24, 1977

[51] Int. Cl.[2] ..... G08B 13/18

[52] U.S. Cl. ..... 340/555; 340/568

[58] Field of Search ..... 340/280, 283, 258 D, 340/258 R, 258 B

[56] References Cited

U.S. PATENT DOCUMENTS

| | | | |
|---|---|---|---|
| 3,309,689 | 3/1967 | Keeney | 340/258 B |
| 3,432,842 | 3/1969 | Poznanski | 340/280 |
| 3,544,988 | 12/1970 | Astheimer | 340/280 |
| 3,719,938 | 3/1973 | Perlman | 340/258 B |
| 3,745,550 | 7/1973 | Anthony et al. | 340/258 B |
| 3,930,249 | 12/1975 | Steck et al. | 340/283 |

*Primary Examiner*—Glen R. Swann, III

*Attorney, Agent, or Firm*—Posnack, Roberts, Cohen & Spiecens

[57] ABSTRACT

A security system is provided in which the monitoring of an article to detect an alarm condition involves sensing the effect of the article on ambient electromagnetic radiation, such as light, and initiating an alarm when the effect of the article on the radiation indicates an alarm condition. According to one aspect of the invention, the effect of the article on ambient radiation is sensed by comparing direct measurements of the radiation with measurements of the radiation along a path normally intercepted by the article. In one form, the security arrangement of the invention includes two light sensing devices, one of which is arranged behind the article to be protected, or is otherwise concealed by such article, and the other of which is arranged to sense ambient radiation. These lead directly into a group of comparators, the output of which is sensed for rate of change in order to control the sounding of a local alarm or a full-security alarm. The alarms may also be tripped directly by respective ones of the comparators or by devices for sensing tampering with the arrangement.

6 Claims, 10 Drawing Figures

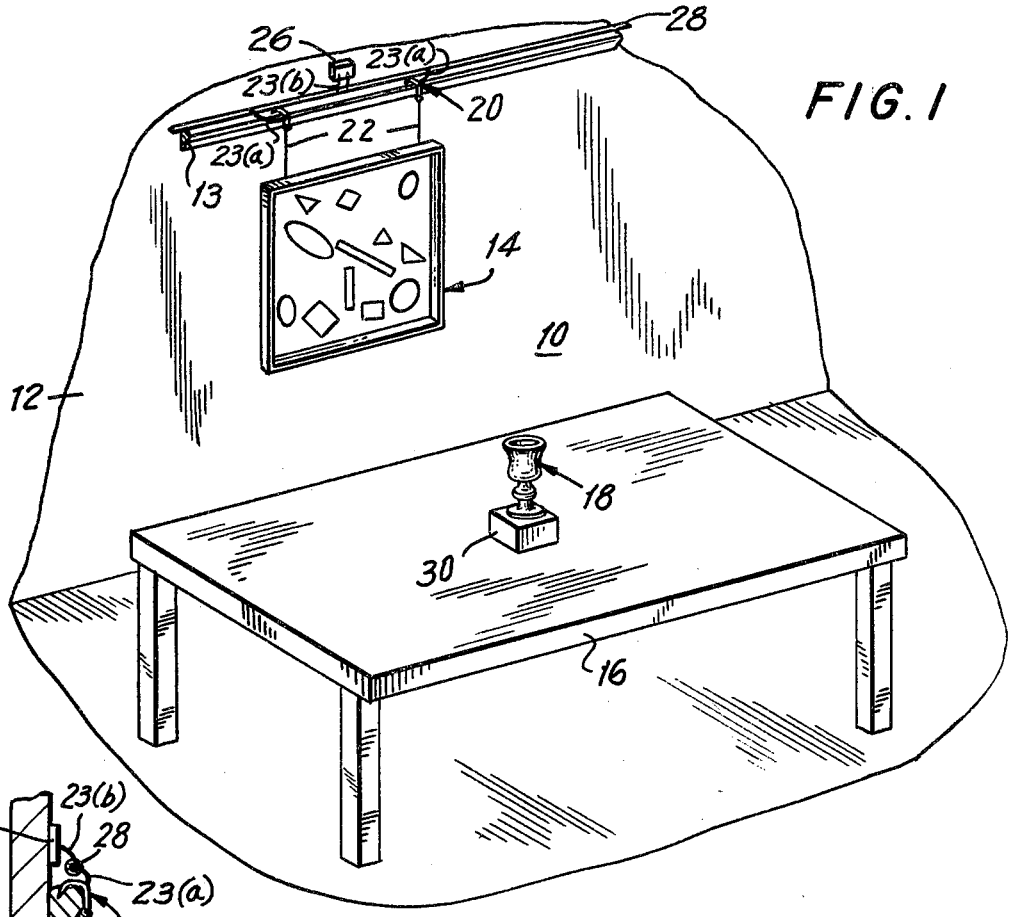
FIG. 1
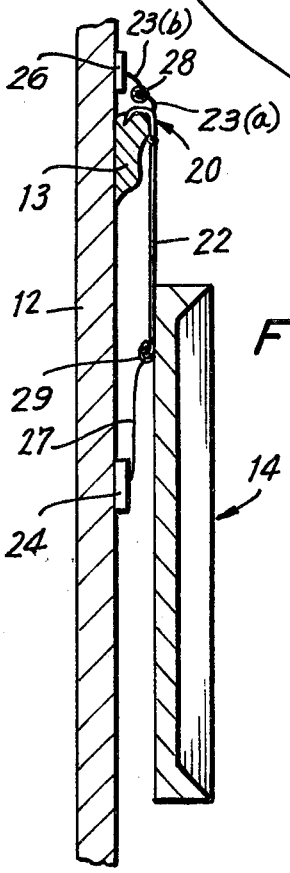
FIG. 2
FIG. 3
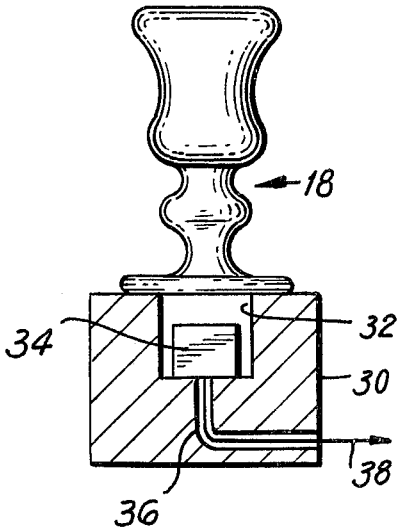

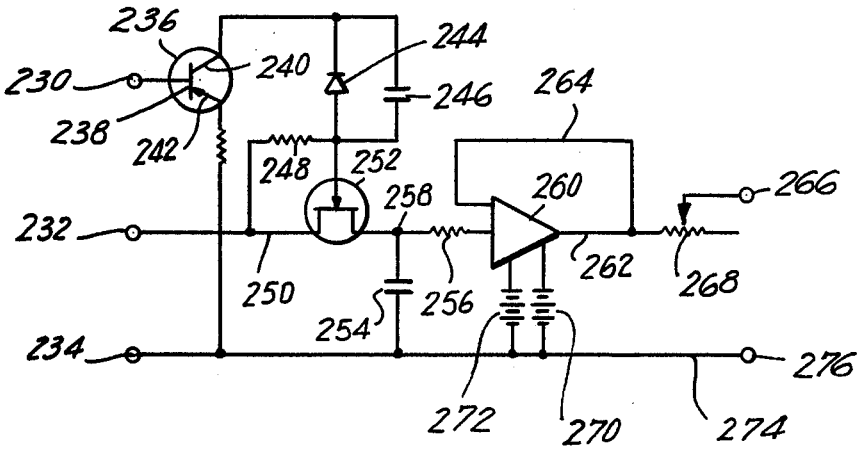
FIG. 9
FIG. 10
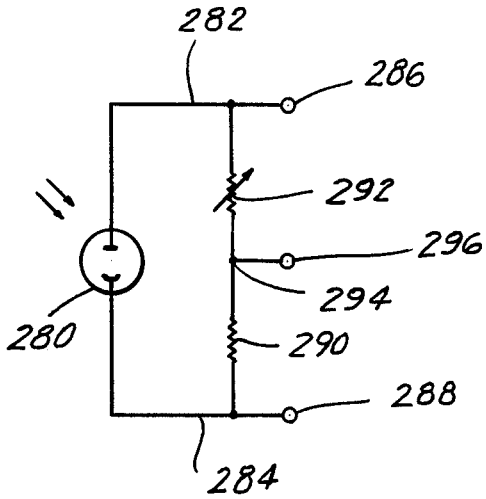

PHOTO ELECTRIC SECURITY SYSTEM

FIELD OF THE INVENTION

This invention relates to methods and systems for protecting valuable and/or irreplaceable articles or objects.

BACKGROUND OF THE INVENTION

Commonly employed security systems, such as used in museums, art galleries, shops, safe deposit vaults, banks or the like, do not protect each of the objects of value therein as such objects are generally too numerous or too small or cannot be altered to provide the necessary supports for the attachment of security devices. The usual security system solves this problem by concentrating a protection on the case in which the object is displayed, the room in which objects are stored, or the room or building in which the objects are contained. In addition, common security devices are far too expensive for the protection of individual objects, except in instances where only a small number of objects are being protected, or in instances wherein the objects are extremely valuable.

The commonly known type of security system has certain disadvantages. To begin with, the object is specifically what should be protected from thieves or vandals and not the case, room or building in which the object is accommodated. Moreover, false alarms arise too frequently due to occurrences which are not attempts to steal or damage the protected objects, but which are instead accidents, negligence or other occurrences involving the case, room or building accommodating the object. Such occurrences include accidental breaking of windows and the like that should, of course, be investigated by security personnel, but which do not constitute a true alarm situation or alert because of the lack of threat to the object being protected.

Another disadvantage of commonly used security systems is their failure to protect objects which are not located within cases and are accessible to the public during some part of the day. To distinguish between touching and stealing is almost impossible, or in most cases, prohibitively expensive. Touching, while not allowed, is a commonplace occurrence but does not constitute an act which requires setting off an alarm. On the other hand, stealing a painting hung on a wall requires the removal of the same and frame or the cutting of the painting out of the frame leaving the frame mounted on its supporting wall as before. Known systems cannot protect such an object while allowing access to the object for reasons of viewing and appreciation.

U.S. Pat. No. 666,737 shows a burglar alarm system in which is employed the combination of a vault or other like structure, the walls of which are impervious to waves of radiant energy, there being a sensitive electrical device arranged within the vault or other such structure, and adapted to operate upon the admission of such radiant energy through an opening or entrance in such walls, and an electrical signal appliance controlled by such sensitive device. Herein, as distinguished from the invention to be disclosed hereinafter, the protection while ultimately afforded to the object or objects themselves is predicated upon the interference with radiant energy of the walls of the structure surrounding the object to be protected.

U.S. Pat. No. 3,886,351 provides a photo-responsive means in an interface circuit, which photo-responsive means is positioned to receive light signals for developing electrical output signals as a function of the received light energy. A first differential amplifier is connected to receive the electrical output signals as a first input, and a known fixed reference as a second input. The first differential amplifier generates first and second output signals having a differential therebetween as a function of the differential between its received inputs. First and second unidirectional current paths connect the first and second output signals of the first differential amplifier as inputs to a second differential amplifier. Although the circuit disclosed employs a comparison with a fixed reference, this is unlike the comparison employed in accordance with various embodiments of the invention as will become apparent hereinafter.

U.S. Pat. No. 3,813,540 relates to a circuit for optically sensing coded data on a record medium and including a photosensitive transducing means. In order to render the circuit independent of background brightness variations, provision is made of load impedance, particularly arranged so that the voltage drop is proportional to the natural logarithm of current flowing through the transducing element. The voltage difference resulting from sensing contrasting marks on the record medium depends only on the contrast in reflected light and not on the absolute value of current on the transducing element. This particular disclosure relates generalized features which may be employed in accordance with the invention, but does not use these features for security systems as will be discussed hereinafter.

SUMMARY OF THE INVENTION

Whereas the commonly used security employing a photoelectric system uses a beam of light, which is either visible or invisible to the naked eye, to cause an alarm when the beam of light is broken, the invention employs light sensing device or combination of devices connected to a discriminating alarm and control circuit with the discriminating alarm and control circuit being self-monitoring and capable of distinguishing between types of threats to the object or article to be protected. A photoelectric device or the like senses the amount of light behind or under the object to be protected and a change in ambient light levels or angles which constitute a threat to the object gives rise to various types of alarms which can be distinguished.

It is an object of the invention to provide an improved security system.

It is another object of the invention to provide an improved security system and method which can be employed in connection with individual articles to be protected as contrasted with protecting the enclosure in which such object or objects are encased or accommodated.

Yet another object of the invention is to provide improved security techniques and arrangements susceptible of being conveniently and economically employed in museums and the like.

In accordance with one of its aspects, the invention provides a method of monitoring an article to detect an alarm condition comprising sensing the effect of the article on ambient electromagnetic or sonic radiation, such as light, and initiating an alarm when the effect of the article on the radiation indicates an alarm condition.

According to another aspect, the invention proposes sensing the effect of the article on ambient radiation by comparing direct measurements of the radiation with measurements of the radiation along a path normally intercepted by the article or object being protected.

Still another aspect of the invention relates to sensing changes in the ambient radiation which do not indicate an alarm condition and preventing the initiation of an alarm as a result of such changes.

According to the invention, there is provided a security arrangement comprising an area having ambient light therein, an article requiring security monitoring in said area, a light sensor in said area for the formation of an electrical signal, said article being located, for example, adjacent said sensor in intercepting relationship with said ambient light, and alarm means coupled to said sensor for responding to said electrical signal. The area may include a wall and said article may be mounted on said wall with the sensor being located between the article and wall. Alternatively or cumulatively, said area may include an article support having an opening therein, said sensor being located in said opening, said article resting on said support and normally obturating said opening to conceal the sensor from the ambient light.

According to the invention, there may be provided sensing means for sensng the ambient light to form a reference level and comparator means to compare the electrical signal with the reference level to form a comparison signal for determining an alarm situation.

According to another feature of the invention, there may be provided rate means to test the rate of change of the comparison signal for determining the existence of an alarm situation.

According to yet another advantageous feature of the invention, means may be provided responsive to extreme ambient light levels for operating the alarm means. Furthermore, there may be provided means for actuating the alarm means upon determining that there has been a tampering with the arrangement.

According to still another aspect of the invention, there is provided a security arrangement for protecting an object, said arrangement comprising first and second means sensitive to electromagnetic radiation and respectively adapted for sensing ambient radiation and ambient radiation intercepted by said object to generate respective signals, comparator means for comparing said signals, and alarm means controlled at least in part by said comparator for generating an alarm indicating an alarm situation.

According to a further feature of the invention, there may be provided sensitivity adjustments for said first and second means, the sensitivity adjustment for the second means being responsive to the first means.

According to still a further feature of the invention, there may be provided ambient reference signal means controlled by said first means and high and low comparator means comparing the ambient reference signal with the signal of the second means to control said alarm means.

According to still a further feature of the invention, said comparator means may include positive and negative comparators for comparing positive and negative excursions of one of said signals relative to the other.

Other objects, features and advantages will become apparent from the detailed description of some preferred embodiments which follow hereinafter as illustrated in the accompanying drawings.

BRIEF DESCRIPTION OF THE DRAWING

In the drawing:

FIG. 1 is a fragmentary perspective view of an area accommodating a hanging picture and a supported object which are to be protected by respective security systems in accordance with the provisions of this invention;

FIG. 2 is a diagrammatic sectional view through the wall supporting the picture in FIG. 1 as well as the picture hanging on the wall demonstrating one possible arrangement of the security system in connection therewith;

FIG. 3 is a diagrammatic sectional view of the supported object in FIG. 1 illustrating the provision of a part of the security system in connection therewith;

FIG. 9 is a sample and hold circuit utilized in the circuit of FIG. 4; and

FIG. 10 is a schematic circuit of a room ambient radiation circuit employable in the circuit of FIG. 4.

DETAILED DESCRIPTION

Figure 4:
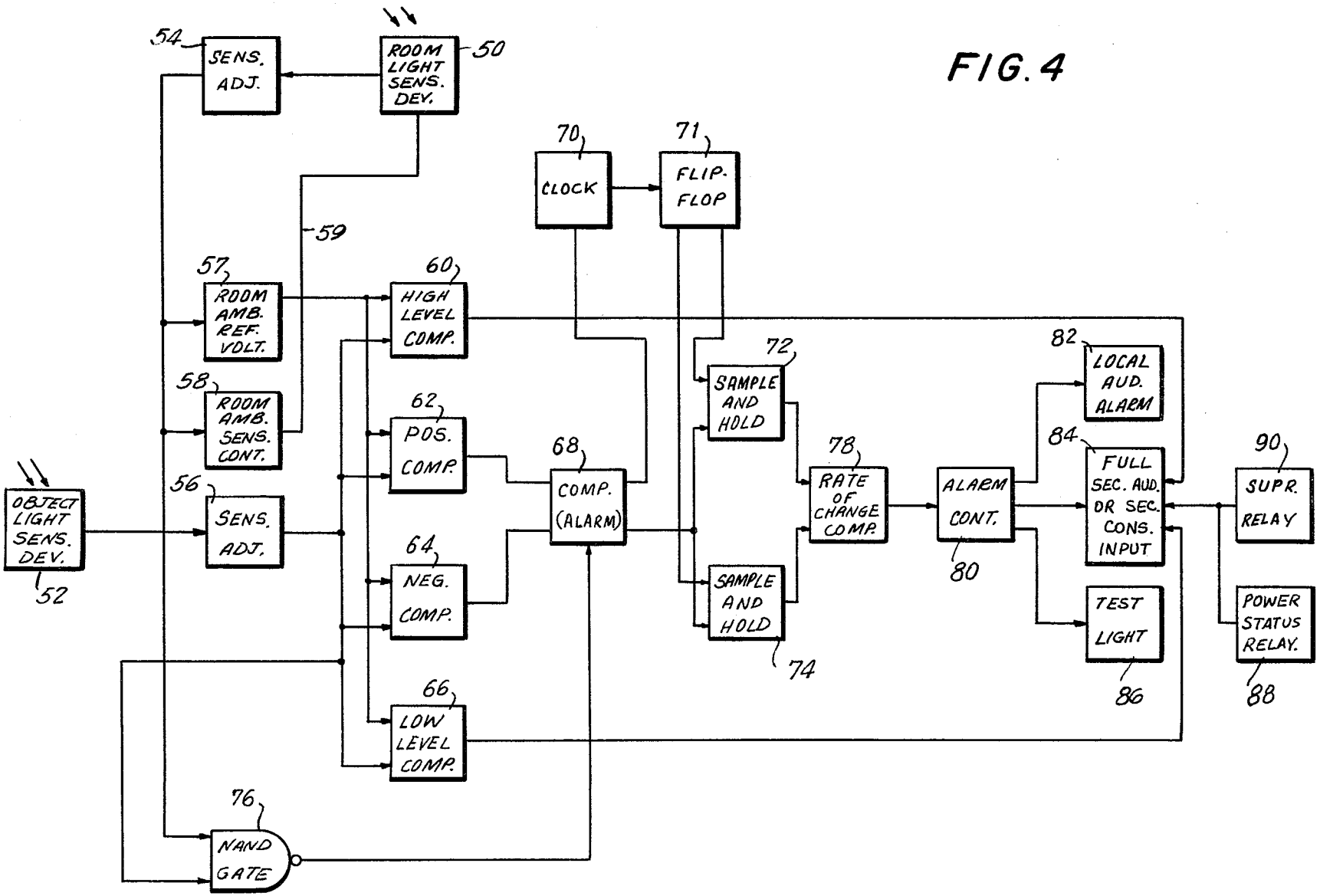
FIG. 4 is a block diagram of a security system arrangement and circuit provided in accordance with a more sophisticated embodiment of the invention.

The present invention utilizes, for example, ambient lighting for the light source to be detected, this light source being representative of various types of electromagnetic or sonic radiation which might be detected and employed in accordance with the principles of the invention. The system provided in accordance with the invention indicates an alarm situation when there is a change of lighting level on the light sensing device which is positioned in the shadow of the object to be protected. The advantages are multiple. All objects to be protected utilize room lighting or sunlight sources or even indirect light sources. Unusual sources, such as flashlights or even matches, may become light sources for the security system. According to one embodiment of the invention, a control circuit measures the normal ambient lighting level and employs this to establish a reference level. The system will go into an alarm condition if the normal level changes in such a manner as to be detected by the circuitry.

Light sensing devices of the invention may be small and inexpensive and can protect objects of various sizes from large paintings to postage stamps and even smaller. Since the light sensing device is an inexpensive mass produced device and is all that is requiired near each object that is to be protected, a large savings or economy is realized with respect to equipment. One control circuit can monitor any number of light sensing devices so that the control equipment can be kept to a minimum.

In accordance with the invention, objects can be protected individually and inexpensively, and for a complete daily cycle. Normal viewing of objects, such as in a museum, will not change the ambient lighting level in the shadow of the objects to be protected, but attempted thievery or vandalism will change this reference lighting level so that an alarm would result. In the rare situation where no ambient lighting level exists no matter how small, flashlights or struck matches might initiate an alarm because the normal or reference illumination level in the shadow of the objects to be protected would be zero. Therefore, an increase in the lighting level would constitute an alarm condition. In the normal situation, however, where some ambient lighting is available, masking the light sensing device in an attempt to compromise the security of the protected object would lower the lighting level in the shadow of the object and would result in an alarm. This all contrasts with the commonly known photoelectric security systems which do not actually protect the object itself against thievery, whereas the invention protects specific individualized objects at all times.

FIG. 1, more particularly, indicates an area 10 in a museum or the like. This area has a wall 12 with a molding 13 on which is supported an exemplary object, such as a framed picture or portrait 14. In the same room, for example, table 16 supports a object 18 through the intermediary of a base or support to be described in greater detail hereinafter.

FIG. 2 illustrates the wall 12 with the picture 14 supported on molding 13, these elements being shown in cross-section. A hook 20 is shown engaging the wall molding 13 for supporting the picture by means of wire 22 which is electrically conductive for a reason to be explained hereafter. A second hook and second wire are hidden from view. The location of these hooks and wires is actually immaterial to the basic operation of the invention. The picture can, in fact, be supported on the wall.

Mounted on the wall 12 is a photoelectric device 24 which may take any one of a number of forms. Where light is the electromagnetic radiation to be monitored, the photoelectric device can be a photovoltaic sensor, such as a silicon cell or a selinium cell. Alternatively, it might be constituted by a photoresistive sensor, such as a CdS cell or the like. Still further, it might be a photoconductive sensor, such as a photodiode, phototransistor, or the like.

The device 24 is shown as being mounted on the wall 12. Alternatively, it might be mounted on the back of the picture 14 or it might be supported in a wide variety of other ways as long as it is supported in a position in which it is in the shadow of the picture 14 which is being protected. The mounting of the device 24 on the wall 12 is thus not critical, this being simply representative of the device 24 being in such a position that the picture 14 is in intercepting relationship relative thereto with respect to ambient radiation.

Above the picture 14 is mounted a device 26. This device is a photosensitive element of the above-noted type. It is positioned to be exposed to ambient light in the area 10 (FIG. 1). The device 26 may also comprise other of the circuit elements to be discussed hereinafter with respect to an overall security system. The devices 24 and 26 are connected by means of a cable 28 to the control circuits. Device 24 is connected to cable 28 by a series of circuits consisting of wire 27, metal eyelet 29, picture hanging wires 22, hook 20 and wire 23(*a*). Device 26 is connected to cable 28 by wire 23(*b*).

The position of the device 26 above the picture 14 is representative only. It is alternatively possible to mount the device 26 in various other positions and in various other ways which do not per se form any limitation of the present invention. It should be noted that the devices 24 and 26 can be manufactured with a wide variety of commercially available techniques which miniaturize the same and provide for economy of cost and size.

FIG. 3 illustrates the object 18 referred to hereinabove relative to FIG. 1. In FIG. 3 is shown a support 30 having an opening 32 therein with the object 18 resting atop the support 30 and obturating the opening 32 to conceal therein a photoelectric device 34 which may be any of the aforenoted types. The support 30 is provided with a channel 36 through which passes a cable 38 for purposes of conducting an electrical signal, formed or generated by device 34, to the control circuitry to be discussed in greater detail hereinafter.

It will follow from what has been described above relative to FIG. 3 that the obturating of the opening 32 by the object 18 attenuates the light of an ambient nature from reaching device 34 until the object 18 is removed from the support 30. When the object 18 is removed from the support 30, the device 34 will be exposed to ambient radiation as the object 18 will no longer be in intercepting relationship with respect to such radiation. The device 34 is therefore normally in the shadow of or protected from ambient radiation by the object 18 which, when removed, enables a signal to be generated and transmitted via cable 38.

FIG. 4 is a block diagram of a control circuit and alarm adapted for being employed with the sensors or photoelectric devices of FIG. 2 and FIG. 3. In FIG. 4 is more particularly illustrated a room or ambient light sensing device 50 and an object or an article light sensing device 52. As will be evident from what has been stated hereinabove, the object light sensing device 52 has the object which it is protecting placed in intercepting relationship relative thereto with regard to ambient light. On the other hand, light sensing device 50 is positioned in such a manner as to be responsive to ambient light conditions in order to establish a reference level.

Connected to the light sensing device 50 is a sensitivity adjuster 54, whereas connected to the light sensing device 52 is a sensitivity adjuster 56.

Connected to the sensitivity adjuster 54 is a room ambient reference voltage circuit 57, whereas connected in parallel thereto is a room ambient sensitivity control 58.

The circuit of FIG. 4 also includes a "high" comparator 60, a "positive" comparator 62, a "negative" comparator 64 and a "low" comparator 66. These feed into a differential comparator 68 which is coupled to a clock circuit 70 (to which is connected flip-flop 71) and two sample and hold circuits 72 and 74. A hand gate 76 is furthermore coupled from sensitivity adjuster 54 and 56 to the differential comparator 68.

The circuit in FIG. 4 furthermore includes a comparator 78, an alarm control 80, local alarm 82, a full security alarm 84 and a test light 86. A power status relay 88 is coupled to the full security line, as is the supervisory relay 90.

Figure 5:
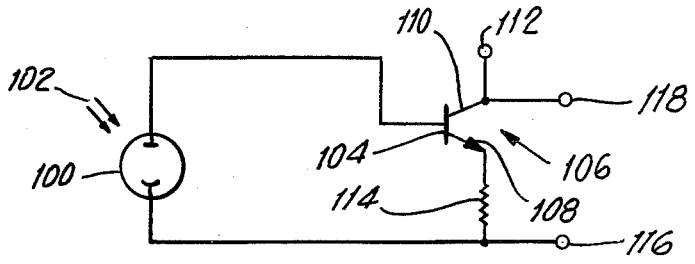
FIG. 5 is a schematic view of a simple control circuit having individual utility or employable in the circuit in FIG. 4.

FIG. 5 illustrates the simplest control circuit or the basic unit to be employed by itself or in the circuit of FIG. 4. More particularly, there is illustrated a photoelectric cell 100 upon which impinges light 102, the photoelectric cell being connected to the base 104 of transistor 106 further having a collector 108 and emitter 110.

The emitter 110 may be connected to a source of positive voltage by means of terminal 112, whereas emitter 108 is connected via resistor 114 to terminal 116. The collector 110 is connected to terminal 118. Terminals 116 and 118 are connected either directly to an alarm circuit, or alternatively, to the sensitivity control as has been mentioned hereinabove relative to FIG. 4.

Figure 6:
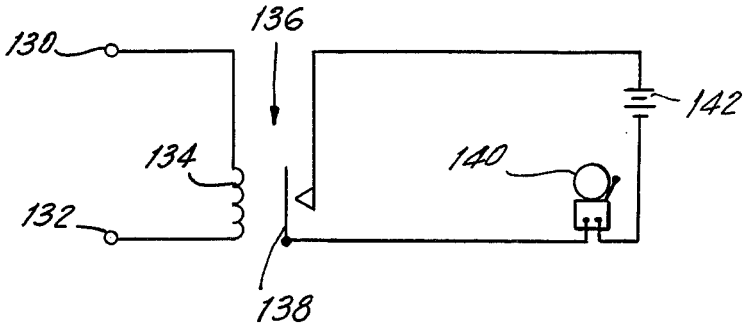
FIG. 6 is a schematic view of a variation of the circuit of FIG. 5.

FIG. 6 illustrates a variation of FIG. 5, whereby the photoelectric cell is connected to terminals 130 and 132 connected to coil 134 of a relay 136 having contacts 138 connected to the terminals of an alarm circuit shown in basic form as including an alarm 140 and a power source 142. As was mentioned hereinabove relative to FIG. 5, the alarm 140 and the power source 142 can be omitted and replaced by the control circuit and alarm of FIG. 4.

Also necessary in the circuit of FIG. 4 is a circuit having the function of providing a comparison with a threshold. Such a comparator is illustrated in FIG. 7 in generalized form for purposes of providing the basic circuitry for the positive and negative comparators of FIG. 4, as well as the high and low comparators employed therein.

Figure 7:
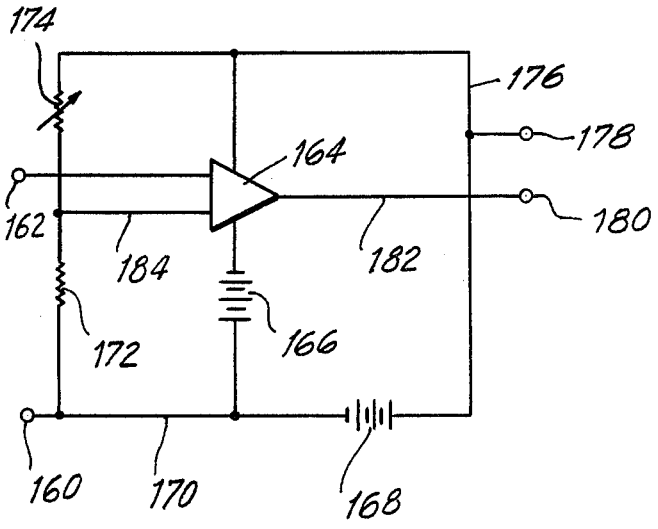
FIG. 7 is a schematic view of a comparator adapted for being employed in the circuit of FIG. 4.

More particularly, in FIG. 7 are shown input terminals 160 and 162. One of these terminals, namely terminal 162, is connected to the op amp 164 which is supplied with power via power supply 166. A second power supply 168 is indicated. The voltage at terminal 162 represents the reference voltage discussed hereinabove.

Terminal 160 is connected to line 170 which is connected via resistor 172 to the other input terminal of the op amp 164. A potentiometer 174 is connected to the resistor 172 and via line 176 to output terminal 178. The other output terminal 180 is connected via line 182 to the output of the op amp 164.

The input fed to the lower input terminal of the op amp 164 and indicated, more specifically, at 184 is the reference level for the plus comparator. When the signal on terminal 162 is greater than the signal on line 184, the op amp 164 is turned on and an appropriate output signal is fed via line 182 to terminal 180.

Terminal 162 is the reference level for the negative or minus comparator. When the signal on terminal 162 is less than that on line 184, the op amp 164 is turned on and an appropriate output signal is fed via line 182 to terminal 180.

The two resistors forming the voltage divider, namely the resistor 172 and the resistance of potentiometer 174, set the threshold voltage that must be exceeded to turn the operational amplifier on.

Figure 8:
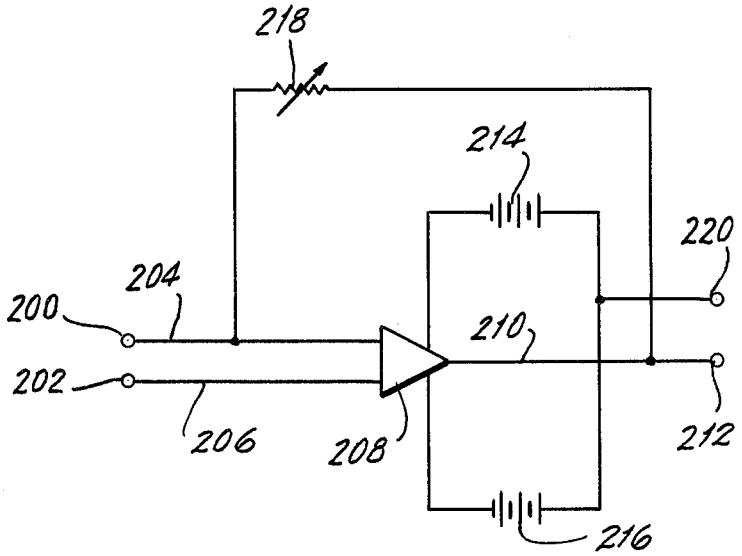
FIG. 8 is a sensitivity adjustment circuit or differential comparator employable in the circuit of FIG. 4.

FIG. 8 illustrates a circuit suitable for use as a sensitivity adjustment circuit in the arrangement of FIG. 4, with a slight variation. Basically, however, the circuit of FIG. 8 is a circuit suitable for use as a differential comparator in the circuitry of FIG. 4. When employed as a differential comparator, the circuit of FIG. 8 will comprise a potentiometer. When this circuit is to be used as a sensitivity adjustment circuit, a photoresistor will be substituted for the potentiometer.

More particularly, the circuit of FIG. 8 includes input terminals 200 and 202 feeding via lines 204 and 206 to an op amp 208 having an output line 210 connected to a output terminal 212. Two DC voltage sources 214 and 216 are connected to the op amp 208 and potentiometer 218 (for which is substituted a photoresistor in order to provide an automatic sensitivity adjustment circuit) is connected in feedback relationship between lines 210 and 204. One terminal of voltage supply 214 is connected to output terminal 220.

When the voltage on line 204 exceeds the voltage on line 206 or when the voltage on line 206 exceeds the voltage on line 204, the op amp 208 is turned on. Adjusting the potentiometer 218 or varying the light on the photoresistor employed in substitution therefor changes the sensitivity of the circuit. An electronic switch on the output would complete the comparator for purposes of constituting the differential comparator 68 in FIG. 4.

FIG. 9 illustrates in schematic diagram a circuit useful as the sample and hold circuits employed in FIG. 4. Herein appears a clock input terminal 230, an input terminal 232 and an input terminal 234. The input level is applied between terminals 232 and 234. The clock input feeds into a transistor 236 having a base 238, a collector 240 and an emitter 242, there being connected to the collector 240 a diode 244 and a capacitor 246 in parallel and resistor 248 in series back to a line 250 connected to terminal 232.

Transistor 252 is connected to terminal 232 and across the terminals is connected a holding capacitor 254. Resistor 256 connects terminal 258 to op amp 260, the output of which appears on line 262 with a feedback circuit being indicated at 264. The output terminal 266 is connected to line 262 by means of potentiometer 268.

DC levels are connected in the form of sources 270 and 272 to the op mp 260. Terminals of these sources being connected to line 274, which is connected to output terminal 276, whereat appears the sampled output level.

An and gate may be added to the input to turn on the circuit when the level input and clock input are simultaneously received according to the circuit of FIG. 4.

The alarm control circuit employed in FIG. 4 may consist of a three pole switch which may lead to the local alarm, to the full security alarm or to the test light.

A room ambient light sensitive device circuit is illustrated in FIG. 10 in the form of the light sensitive device 280 itself connected via lines 282 and 284 to terminals 286 and 288. Across the device 280 is connected a voltage dividing circuit including resistor 290 and potentiometer 292 meeting at junction 294 connected to output terminal 296. Terminals 286 and 288 are room ambient sensitivity control terminals, whereas the terminals 288 and 296 constitute room ambient reference voltage terminals.

Referring back to FIG. 4, there is furthermore employed a flip flop circuit 71 connected to the clock 70 and feeding signals alternatively into the sample and hold circuits 72 and 74, whereby these circuits are alternatively actuated. Moreover, it will be seen that the photosensitive device 50 receives a feedback signal from the room ambient sensitivity control circuit 58 via line 59 and that the sensitivity adjustment circuit 56 transmits output signals from the light sensing device 52 to each of the comparators 60, 62, 64 and 66, whereas these comparators, furthermore, each receives signals from the room ambient reference voltage circuit 57.

In the circuit of FIG. 4, the room ambient light sensitive device 50 establishes a reference voltage by means of the room ambient reference voltage circuit 57 which controls the reference voltage input to the four comparators 60, 62, 64 and 66. The positive comparator 62 senses any positive change in the object or article shadow as sensed by the object light sensing device 52.

The negative comparator 64 senses any negative change in the object shadow as sensed by the object light sensing device 52. Increasing or decreasing the ambient light level in the shadow of the object to be protected turns on either the positive or negative comparators 62 or 64 and is adapted for initiating an alarm or working to that end by operating the differential comparator 68.

The nand gate 76 monitors the outputs of both the light sensing devices 50 and 52 and enables or turns on the comparator 68, when and only if a change occurs in one or the other but not in both of the light sensing devices 50 and 52.

The comparator 68 turns on the clock circuit 70 which sends its output to the flip flop 71. The comparator 68 furthermore sends its output to the two sample and hold circuits 72 and 74.

As each pulse of the clock circuit 70 is received by the flip flop circuit 71, the comparator 68 provides an output which is alternatively sampled by the two sample and hold circuits 72 and 74.

The outputs of these circuits are then compared in the comparator 78. This comparator 78 is adjusted for local conditions and if the rate of change between any two incoming pulses exceeds the adjusted level change rate, then comparator 78 turns on the alarm circuit control circuit 80.

By way of example, a small change in the ambient level of the shadow of the object to be protected exceeding a certain rate of change would result from the moving of the object to be protected by some unauthorized person and, therefore, would initiate an alarm by actuating the alarm control circuit 80 to turn on, for example, the local alarm 82 near the protected object or article.

By way of further example, a large change in the ambient level of the protected object's shadow without regard to the rate of that change would result from the removal or attempted removal of the protected object's shadow from the light sensing device 52 and would initite a full security alarm by actuating full security alarm circuit 84, directly through the high level comparator 60 whose threshold would be dependent on local conditions in the room and the object or article to be protected.

By way of still further example, a reduction below a predetermined level in the ambient light level in the shadow of the protected object's shadow would only occur if an attempt was made to mask the light sensing device 52 or, due to a cutting of the wires in the light sensing device circuit. The full security alarm 84 would, in this case, be actuated directly through the low level comparator 66.

Turning off the roomm lighting or cutting off ambient radiation would not initiate an alarm because the alarm comparator 68 would be inhibited, but the sensitivity of the object light sensing device 52 would be increased to operate in the low ambient light condition along with the sensitivity of the room ambient light sensing device 50.

Removing the power source from the control circuit or the alarm circuit would initiate a full security alarm through circuit 84 by means of the power status relay and battery circuit indicated at 88. This circuit is conventional and is employed in other security systems.

The supervisory relay circuit 90 monitors the operating condition of the control and alarm circuits and would initiate a full security alarm to prevent tampering.

The alarm control circuit 80 can be switched to the test light circuit 86 whenever an authorized person intends to handle or otherwise manipulate the object to be protected. This enables a temporarily deferment of the alarm situation to permit authorized handling of objects or articles to be protected.

From what has been stated hereinabove, there will now appear that the invention provides a method of monitoring an article to detect an alarm condition. This method comprises sensing the effect of the article on ambient electromagnetic radiation and initiating an alarm when the effect of the article on the radiation indicates an alarm condition. The invention may, moreover, comprise sensing the effect of the article on ambient radiation by comparing direct measurements of the radiation with measurements of the radiation along a path normally intercepted by the article. As a feature of the invention, the method of the invention may, furthermore, include sensing changes in the ambient radiation which do not indicate an alarm condition and preventing the initiation of an alarm as a result of such changes.

The method of the invention may still further comprise sensing the radiation along a determinable path and arranging the article to intercept the radiation along said path.

As has been illustrated, the article may be, for example, a painting which is hung on a wall with the radiation sensor being located between the picture and the wall so that the picture intercepts the ambient radiation. Alternatively, and by way of further example, there has been shown an article located above an opening in a support with a radiation sensor being mounted in the opening.

It will now be obvious that the article may be located in a room or such other enclosure as may have natural and artificial light but that the invention will, furthermore, take into account artificial sources of light including, but not limited to, flashlight, matches which have been struck and so forth. It has been shown how the invention will provide for initiating an alarm at either of the opposite extremities of ambient radiation.

There has, furthermore, been disclosed hereinabove a security arrangement comprising an area having an ambient light level therein, an article requiring security monitoring in said area, a light sensor in said area for the formation of an electrical signal, said article being located adjacent said sensor in intercepting relationship with said ambient light, and alarm means coupled to said sensor for responding to said electrical signal. As a feature, it has been shown that a sensing means may be provided for sensing the ambient light to form a reference level and a comparator means to compare the electrical signal with the reference level to form a comparison signal for determining an alarm situation. A rate means has been disclosed to test the rate of change of the comparison signal for determining the existence of an alarm situation or condition. Means have been provided responsive to extreme ambient light levels for operating the alarm means.

There will now be obvious to those skilled in the art many modifications and variations of the methods and arrangements set forth hereiabove. These modifications and variations will not depart from the scope of the invention if defined by the following claims.

What is claimed is:

1. A security arrangement comprising an area having ambient radiation therein, an article requiring security monitoring in said area, a radiation sensor in said area for the formation of an electrical signal, sad article being located adjacent said sensor in intercepting relationship with said ambient radiation, and alarm means coupled to said sensor for responding to said electrical signal, said area including a wall and said article being mounted on said wall with the sensor being located between the article and wall, said arrangement further comprising means coupling said sensor to said alarm means and including a wire supporting said article on said wall and constituting at least part of the coupling between the sensor and alarm means.

2. A security arrangement as claimed in claim 1 wherein the article is a framed picture.

3. A security arrangement comprising an area having ambient radiation therein, an article requiring security monitoring in said area, a radiation sensor in said area for the formation of an electrical signal, said article being located adjacent said sensor in intercepting relationship with said ambient radiation, and alarm means coupled to said sensor for responding to said electrical signal, said arrangement further comprising sensory means for sensing the ambient radiation to form a reference level and comparator means to compare the electrical signal with the reference level to form a comparison signal for determining an alarm situation, and rate means to test the rate of change of the comparison signal for determining the existence of an alarm situation.

4. A security arrangement as claimed in claim 3 comprising means responsive to extreme ambient light levels for operating said alarm means.

5. A security arrangement as claimed in claim 4 comprising means for actuating said alarm means upon tampering with said arrangement.

6. A security arrangement comprising an area having ambient light therein, an article requiring security monitoring in said area, a light sensor in said area for the formation of an electrical signal, said article being located adjacent said sensor in intercepting relationship with said ambient light, and alarm means coupled to said sensor for responding to said electrical signal, said arrangement further comprising sensory means for sensing the ambient light to form a reference level and comparator means to compare the electrical signal with the reference level to form a comparison signal for determining an alarm situation, and means responsive to extreme ambient light levels for operating said alarm means.

* * * * *